US005385295A

United States Patent [19]

McNair

[11] Patent Number: 5,385,295

[45] Date of Patent: Jan. 31, 1995

[54] SIGNALLING DEVICE

[76] Inventor: Rhett McNair, Rte. 13, Box 398, Lake City, Fla. 32055

[21] Appl. No.: 124,037

[22] Filed: Sep. 21, 1993

[51] Int. Cl.[6] ..... B65D 91/00

[52] U.S. Cl. ..... 232/35

[58] Field of Search ..... 232/34, 35

[56] References Cited

U.S. PATENT DOCUMENTS

| | | | |
|---|---|---|---|
| 510,199 | 12/1893 | Sheldon . | |
| 879,022 | 2/1908 | Wolf . | |
| 1,084,893 | 1/1914 | Mullins . | |
| 2,217,310 | 10/1940 | Fatur . | |
| 2,561,007 | 7/1951 | Bierig . | |
| 2,856,123 | 10/1958 | Mary . | |
| 3,275,228 | 9/1966 | Golla . | |
| 3,709,189 | 1/1973 | Widham | 232/35 |
| 4,171,086 | 10/1979 | Hudson . | |
| 4,344,559 | 8/1982 | Widham | 232/35 |
| 4,491,268 | 1/1985 | Faulkingham | 232/35 |
| 4,498,621 | 2/1985 | Diamond . | |
| 4,877,180 | 10/1989 | Shull | 232/35 |
| 4,964,565 | 10/1990 | Wood | 232/35 |
| 4,986,467 | 1/1991 | Bibbee | 232/35 |
| 5,040,723 | 8/1991 | Kelley, Jr. . | |
| 5,201,465 | 4/1993 | Limehouse | 232/35 |
| 5,255,843 | 10/1993 | Deakyne . | |

OTHER PUBLICATIONS

Copy of packaging for "Mail's Here" signalling device (indicated as being patented).

"Mail Time" signalling device, *Good Housekeeping*, Jun. 1993.

"Big Box" signalling device, *Hanover House* catalog, Spring '93.

"Pony Express" mailbox, ALSTO's handy Helpers catalog, Autumn '92.

Prior art signalling device invented by Rhett McNair.

*Primary Examiner*—Michael J. Milano

*Attorney, Agent, or Firm*—Dowell & Dowell

[57] ABSTRACT

A signalling device which is mountable on a rural route mailbox comprises a housing which encloses a light fluorescing material and an activating element which extends exteriorly of the housing. The activating element is triggered by opening the mailbox door, which moves the light fluorescing material to an exteriorly observable position within the housing where it emits a visual signal to residents that mail has been received.

18 Claims, 4 Drawing Sheets

SIGNALLING DEVICE

BACKGROUND OF THE INVENTION

FIELD OF THE INVENTION

This invention relates to a signalling device, and more particularly, to a mailbox mountable signalling device enclosing a light fluorescing material which is exposed when the mailbox door is opened by a postman delivering mail to provide an observable signal indicating that mail has been received.

Mailbox mountable signalling devices have been known in the art. Such devices have included signalling structures of various sophistication to alert residents that mail has been delivered. They have ranged from expensive radio-controlled beepers and battery powered lights, to relatively inexpensive colored flags, reflectors and like signalling structures that have been activated manually by the resident or postman, and automatically by opening of the mailbox door or by inserting mail in the mailbox. Various types of signalling devices are exemplified by U.S. Pat. Nos. 510,199 to Sheldon; 879,022 to Wolf; 1,084,893 to Mullins; 2,217,310 to Fatur; 2,561,007 to Bierig; 2,856,123 to Mary; 3,275,228 to Golla; 4,171,086 to Hudson; 4,498,621 to Diamond; and 5,040,723 to Kelley, Sr.

The above-mentioned signalling devices for mailboxes have been inadequate, however, for at least a number of reasons.

The known signalling devices have not provided a light fluorescing material that absorbs the full spectrum of outdoor light, including normally invisible ultraviolet light, and emits it in the form of visible fluorescent light in all directions to signal to residents that mail has been delivered. Such device would require no solar cells, bulbs, wires or electrical connections, or extraneous or self-contained sources of electrical power such as batteries, to operate. It would require only outdoor light to activate the fluorescing material and so would provide the significant advantage of requiring no maintenance to assure its continued operation.

Moreover, such a light fluorescing material would emit light that visibly contrasts with the opaque portions of the housing, mailboxes and their surrounding environments. This contrast would assure that the signal remains highly visible in all types of light conditions, including situations of limited visibility due to clouds or precipitation. Accordingly, the signalling device would eliminate the need for multiple trips to the mailbox, and thus would be particularly advantageous for use by the elderly and disabled.

SUMMARY OF THE INVENTION

The present invention has been made in view of the above-described inadequacies of the related art and has as an object to provide a signalling device which is particularly suitable for mounting on a conventional rural route mailbox, and includes a light fluorescing material which provides a highly visible signal to residents indicating that mail has been received.

Additional objects and advantages of the present invention will become apparent from the detailed description which follows, considered in conjunction with the accompanying drawing figures.

To achieve the objects of the invention, as embodied and broadly described herein, the signalling device in accordance with the present invention comprises a housing including a base which is attachable to a mailbox, a movable light fluorescing material enclosed within the housing, and an activating element for moving the light fluorescing material to an exteriorly observable position within the housing in response to the mailbox door being opened so as to signal that mail has been deposited in the mailbox. Once the light fluorescing material has been moved to a non-signalling position, it is positively retained by an inner magnet or other device in that position until the signalling device is reactivated by an individual opening the mailbox door to deliver mail.

DETAILED DESCRIPTION OF THE PREFERRED EMBODIMENTS

Figure 1:
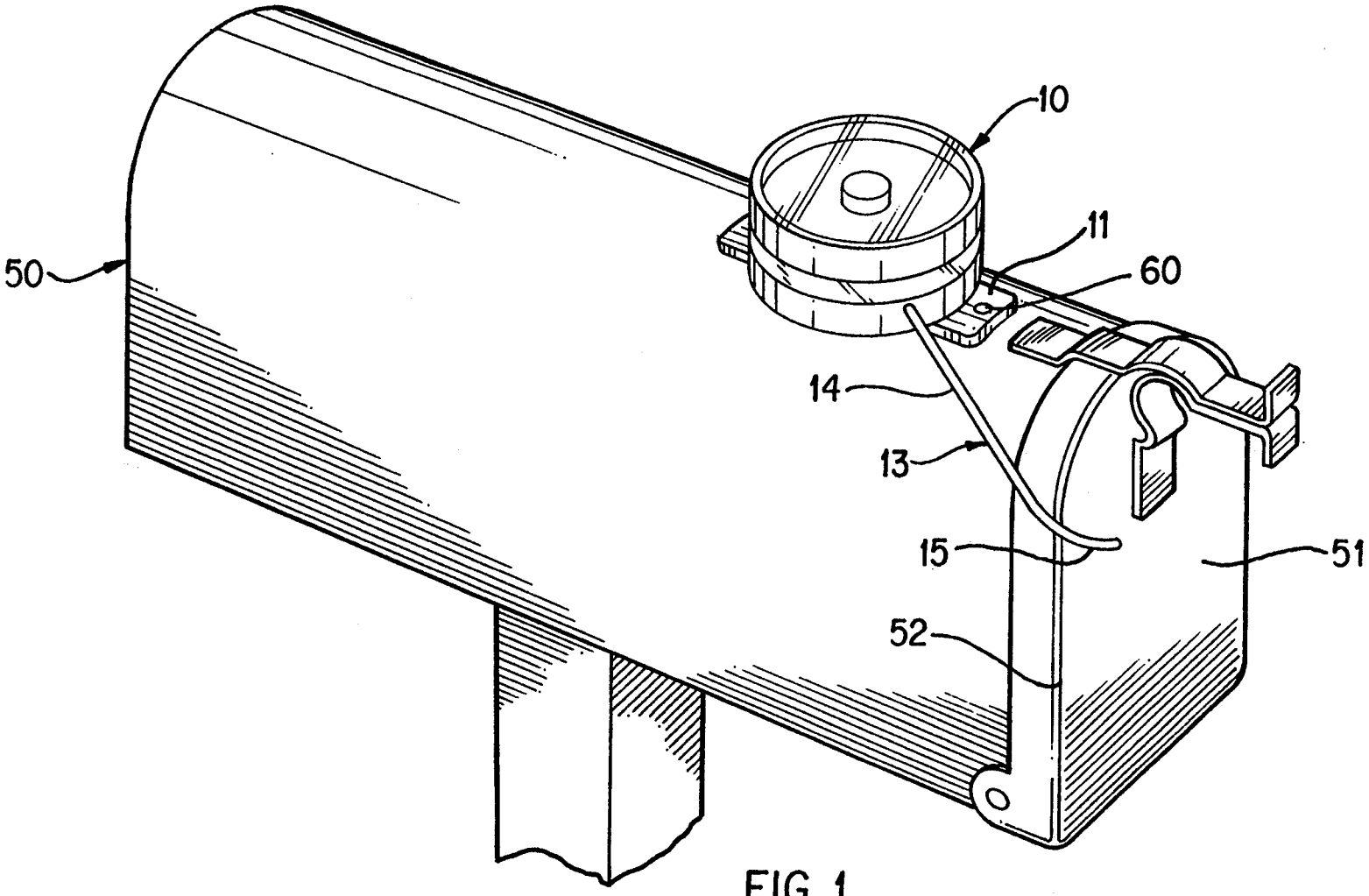
FIG. 1 is a perspective illustrational view of an embodiment of a signalling device of the invention mounted to the upper surface of a mailbox.
Figure 2A:
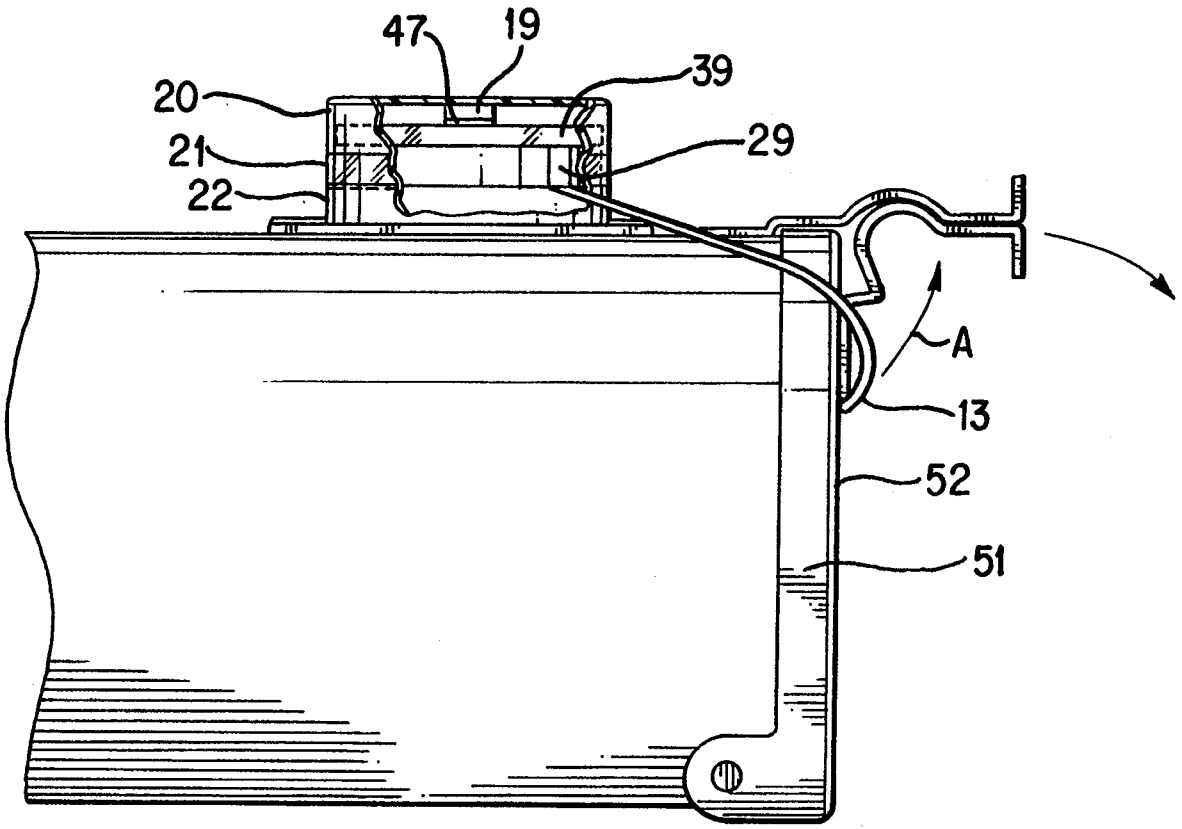
FIG. 2A is a partially broken away side illustrational view of the signalling device of FIG. 1 in its unactivated state with the mailbox door in the closed position.
Figure 2B:
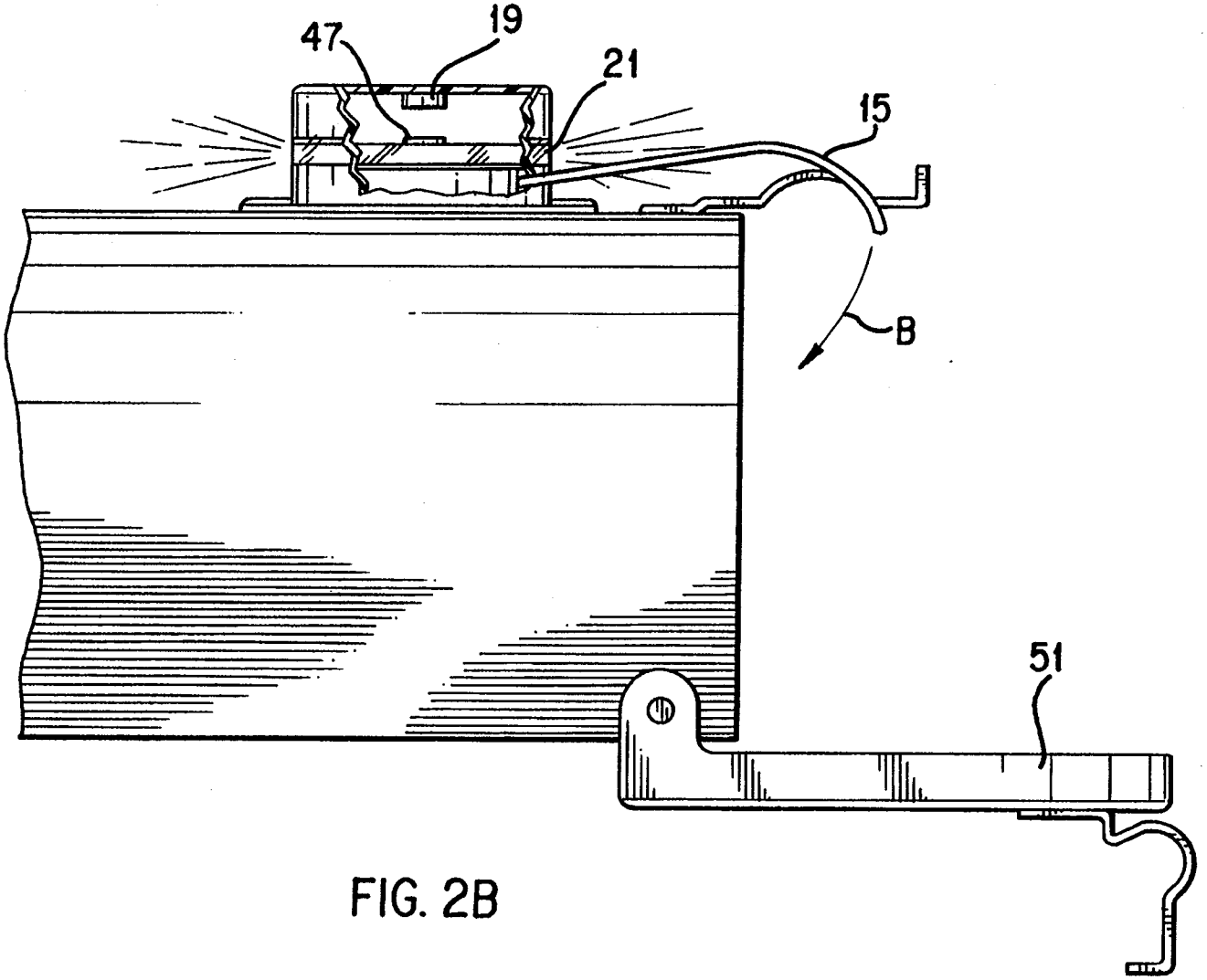
FIG. 2B is a partially broken away side illustrational view of the signalling device of FIG. 1 in its activated state after the mailbox door has been opened.
Figure 3:
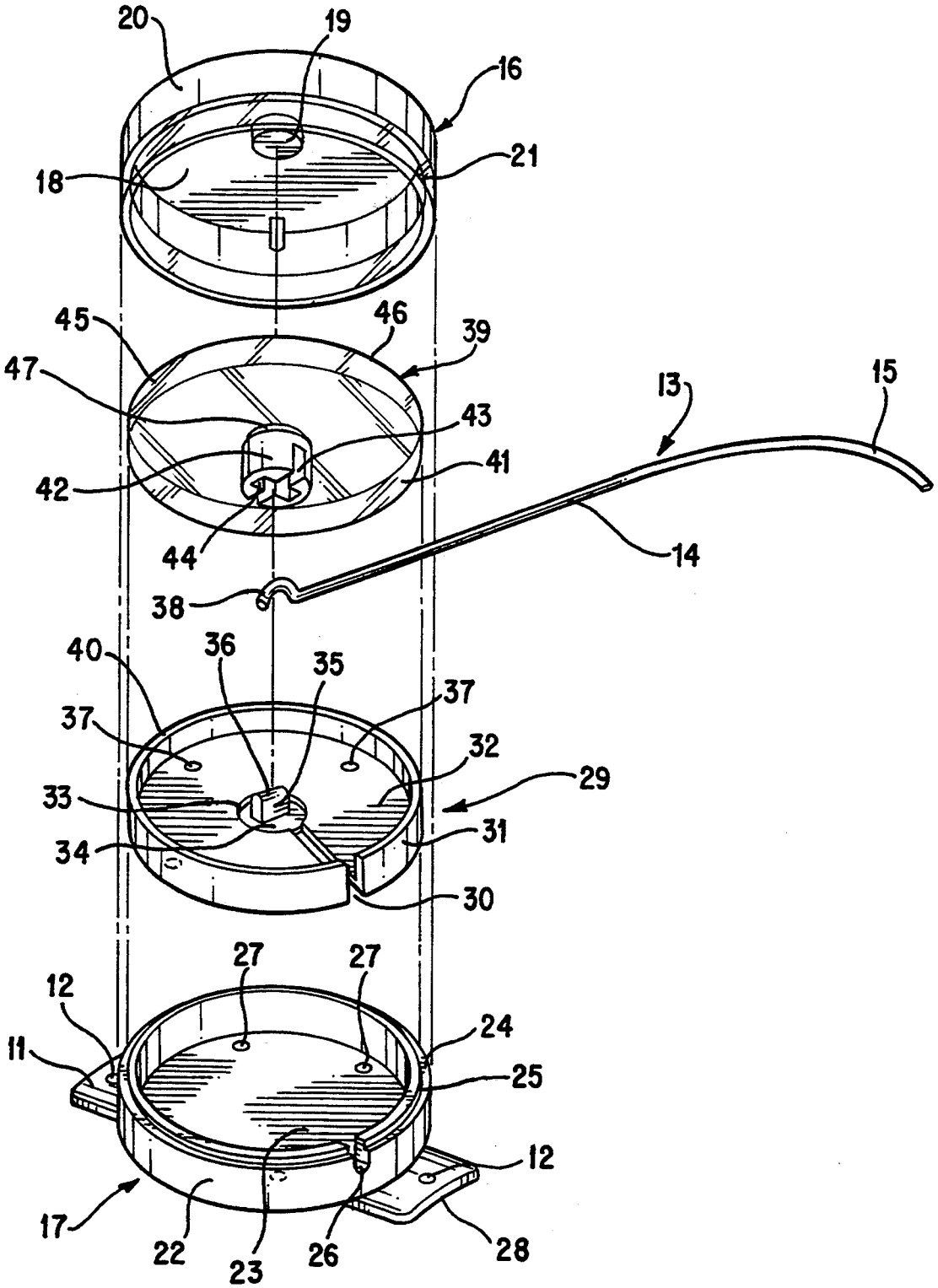
FIG. 3 is an exploded perspective view of the signalling device of FIG. 1.

With reference to the drawing figures, FIGS. 1–3 illustrate a signalling device 10 in accordance with the present invention. FIG. 1 shows the signalling device mounted to the arcuate top surface of a conventional rural route mailbox 50 having a hinged door 51 at its forward end which is opened and closed by mail carriers when mail is delivered.

As illustrated, the signalling device preferably has a cylindrical shaped housing and a flanged base 11 having holes 12 (FIG. 3) for receiving fasteners 60 such as screws to fasten the device to the mailbox. The housing may optionally be formed in other shapes such as rectangular, triangular and the like.

The signalling device comprises an activating arm 13 for activating the device to emit an observable light signal indicating that mail has been received when the mailbox door is opened. The activating arm preferably is a metallic rod composed of brass or the like. The rod has a straight portion 14 which extends exteriorly from the housing and an arcuate end portion 15 which rides over the edge 52 of the mailbox door as it is opened.

The structure of the signalling device will now be described in greater detail with reference to FIG. 3. The signalling device comprises an outer housing having an upper housing portion 16 and an interengageable lower housing portion 17. The upper housing portion includes a top wall 18 which is composed of a light transparent material such as a clear plastic or the like. A magnet 19 is attached to the to wall approximately at its center and extends downwardly from its lower surface.

The upper housing portion 16 further comprises an upper sidewall formed integrally with the top wall 18 which includes an upper opaque portion 20 and a lower, contiguous light transparent portion 21. The opaque portion is a ring of a dark-colored plastic, paint or the like, which surrounds a light transparent inner wall (not shown) formed integrally with the light transparent portion 21. Its outer surface is preferably black to provide high contrast.

The lower housing portion 17 has a unitary structure and comprises lower sidewall 22, bottom wall 23 and the flanged base 11. The lower housing portion is preferably composed of the same material as the opaque portion 20 of the upper housing portion. The top face of the lower sidewall includes a shoulder 24 and an inwardly spaced rim 25 which are interengageable with a shoulder and rim (not shown) formed on the lower face of the light transparent inner wall 21 of the upper housing portion 16 when the signalling device is assembled. The lower sidewall further defines a slot 26 for receiving and supporting the rod 14.

The bottom wall 23 of the lower housing portion includes a plurality of spaced openings 27 about its periphery for draining condensation out of the device to reduce fogging of the inner surfaces of the light transparent portion 21 and the top wall 18.

The base 11 of the lower housing portion 17 is formed integrally with the bottom wall 23 and has a concave shaped lower surface 28 which is positionable on the arcuate upper surface of the mailbox as illustrated in FIG. 1.

The signalling device further comprises a tray 29 which is caused to drop and nest within the lower housing portion 17 when the signalling device is activated as depicted in FIG. 2B by opening the mailbox door. The tray otherwise remains in a raised position adjacent to the light transparent portion 21 of the upper housing portion when the mailbox door is closed and the signalling device is unactivated as shown in FIG. 2A. A radial channel 30 extends through sidewall 31, diametrically across a portion of bottom wall 32 and terminates at the outer periphery 33 of a recessed region 34 formed centrally in the bottom wall. An integrally formed post 35 having a rounded upper surface 36 protrudes upwardly from the recessed region. The interiorly facing surface of the bottom wall 32 of the tray and the post are preferably each colored white to reflect any light which passes through the bottom face of the light fluorescing material 39 in an upwards direction into the disk. The bottom wall of the tray includes a plurality of spaced holes 37 for draining moisture out of the tray by way of the holes 27 formed in the lower housing portion 17.

The rod 13 includes a hooked end portion 38 which is shaped to overly the rounded upper surface of the post 35. The straight portion 14 of the rod extends through the slot 26 in the lower housing portion.

Disk 39 is composed of a light fluorescing material. It has a centrally located opening (not shown) extending therethrough. An upper portion of a downwardly extending lug 42 is inserted in the disk opening to secure the lug to the disk. The lug includes a pair of slots 43 and 44 which are substantially perpendicular with respect to each other. The hooked end portion 38 of the rod 13 fits within the slot 43 which extends across the diameter of the lug 45, and the post 35 of the tray fits within the slot 44 when a bottom portion of the lug is inserted in the recessed region 34 of the tray. The outer surface of the lug is preferably white colored so that it reflects light horizontally toward the side face 45 of the disk 39. Its bottom surface is preferably adhered to the bottom surface of the sunken region 34 to secure the light fluorescing disk to the tray. A disk of ferrous material 47 covers the top surface of the lug and is partially received within the disk 39. The upper surface of the ferrous material protrudes slightly above the top surface 46 of the disk. Interaction between the ferrous material and the magnet 19 maintains the disk in a raised position when the signalling device is unactivated as will be described below.

The disk 39 is preferably formed by mixing together an optically clear resin and a fluorescing dye. The resin is preferably an acrylic composition having a high resistance to weather and ultraviolet light. Other resins such as polycarbonate and optically clear polymers may optionally be used. These other materials are less preferred, however, because they require ultraviolet light additives to prevent their deterioration, and such additives absorb ultraviolet light and decrease the absorption of ultraviolet light by the fluorescing dye.

The mixture of the resin and fluorescing dye is injection molded or cast into the desired disk shape. These forming operations produce smooth surfaces on all faces of the disk. The smooth surfaces of the upper 46 and lower 41 faces are desirable so as to maximize the amount of light absorption. The side face of the disk, in contrast, preferably has a rough surface to maximize the intensity of fluorescent light emitted through its surface. To achieve a rough surface finish, the side face is preferably machined, using a lathe or the like, with a cutting tool designed to remove material in the form of chips. A rough surface may optionally be formed by a molding process.

The fluorescing material may optionally be formed in other shapes depending on the shape of the outer housing. For example, for a rectangular housing, it may be rectangular in shape. In such instance, the upper and lower faces have smooth surfaces, and preferably all four side faces have rough surfaces so as to emit high intensity fluorescent light over a full 360 degree range.

The fluorescing material collects light, including normally invisible ultraviolet light which passes through the smooth upper surface 46, converts it to a longer wavelength, and amplifies and emits fluorescent light through the relatively brighter side face 45. This light conversion is dependent on the fluorescing dye, and different dyes may be used to vary the color of the emitted light. For example, the emitted light may be green, blue, yellow, red and the like. Green is the preferred color because it has a high level of contrast with respect to the opaque portions 20 and 22 and is visible from a long distance. The process of light absorption and emission continues as long as outdoor light impinges on the upper surface of the light fluorescing material.

The emitted light is visible during direct sunlight or diffuse daylight weather conditions. Its brightness is dependent on several factors. First is the intensity of the outdoor light. Although the disk absorbs light in all Light conditions, more light is absorbed as the outdoor light intensity increases. Second is the relative roughness of the disk surface. A rough surface scatters and reflects more light, so that even a small amount of incident light is absorbed and emitted by the light fluorescing material. The third factor is the relationship between the absorption and emission surface areas. In the preferred embodiment of the signalling device 10, this relationship is between the surface area of the top 46 and bottom 41 surfaces of the disk relative to the surface area of the side face 45 which is determined by its thickness. In other words, the greater the surface area of the top and bottom faces and the smaller the side face surface area, the brighter is the emitted light.

In operation, outdoor light passes through the transparent top wall 18 of the upper housing portion and into the signalling device interior where the incident light impinges on the fluorescing disk upper surface 46 and a portion of the light is absorbed. The fluorescing disk is maintained slightly below the lower surface of the top wall 18 by magnetic interaction between the magnet 19 and ferrous material 47. The rod is attached to the lug 42 such that the protruding portion of the rod 13 can move vertically. The rod extends through the slot 26 in the side wall of the lower housing portion 17, and the point at which the rod passes through the side wall is the leverage point. The arcuate end portion 15 of the rod overhangs the closed door 51 of the mailbox as shown in FIG. 2A.

When the mailbox door is opened in the clockwise direction, the arcuate end portion of the rod rides over the edge 52 of the mailbox door and is raised in the direction of arrow A in FIG. 2A. This movement of the rod exerts downward pressure on the hooked end portion 38 of the rod mounted within the housing which pulls the fluorescing disk 39 downwardly away from the top wall 18 by exceeding the magnetic force exerted on the ferrous material 47 by the magnet 19. This causes the fluorescing disk to drop downwardly within the housing to its activated position as illustrated in FIG. 2B. When the disk is in this position, its side face 45 is adjacent to and clearly visible through the light transparent portion 21 located between the opaque portions 20 and 22 which encircle the housing. The disk emits a brilliant glowing light through the side face which is visible from distances up to several hundred feet away. This highly visible signal allows residents to visually monitor their mail delivery from within the comfort of their homes and eliminates unnecessary trips to the mailbox.

When the fluorescing disk 39 is in the lowered, activated position, the arcuate end portion of the rod 13 is raised sufficiently so that the mailbox door can be closed by the postman without encountering any interference from the rod. After the resident sees the emitted light signal and retrieves the mail, the rod is pushed downward in the direction of arrow B in FIG. 2B to raise the fluorescing disk within the housing so that the light emitting edge is hidden behind the opaque portion 20 of the upper housing portion 16 and is again held in that unactivated position (FIG. 2A) by the magnet 19. This resets the signalling device so that during the next mail delivery, the postman will open the mailbox door and cause the fluorescing disk to drop down to the activated position illustrated in FIG. 2B.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A signalling device for use with a mailbox including a swingable door, comprising:

a housing including a light transparent top wall,and a sidewall having a light transparent portion and opaque, portions adjacent thereto;

a movable light fluorescing material enclosed within said housing; and activating means for moving said light fluorescing material to an exteriorly observable position within said housing adjacent to said light transparent portion in response to the door being opened so as to signal that mail has been deposited in the mailbox.

2. The signalling device of claim 1, wherein said light fluorescing material comprises an optically clear resin and a light fluorescing dye.

3. The signalling device of claim 2, wherein said optically clear resin is an acrylic composition.

4. The signalling device of claim 2, wherein said light fluorescing material emits green colored fluorescent light.

5. The signalling device of claim 1, wherein said light fluorescing material includes an upper face and a lower face each having a smooth surface, and a side face having a relatively rough surface with respect to said smooth surface.

6. The signalling device of claim 1, wherein said housing includes a bottom wall having a base which defines a pair of openings for receiving fasteners to mount said signalling device to a mailbox.

7. The signalling device of claim 5, wherein said housing is substantially cylindrical shaped and said light fluorescing material is a disk.

8. The signalling device of claim 7, further comprising a tray located below and secured to said light fluorescing material, said tray having a white colored interior surface and a sidewall with an opaque outer surface.

9. The signalling device of claim 8, wherein said tray includes a recessed region having a post extending upwardly therefrom, and a lug secured to said light fluorescing material and extending downwardly therefrom which surrounds said post and is received by said recessed region to secure said light fluorescing material to said tray.

10. The signalling device of claim 9, wherein said lug includes an upper surface composed of a ferrous material, a magnet secured to said top wall of said housing and extending downwardly therefrom, said magnet being interengageable with said ferrous material to maintain said light fluorescing material in a raised, exteriorly unobservable position within said housing.

11. The signalling device of claim 10, wherein said ferrous material and said magnet are separated from each other in said exteriorly observable position and said side face of said light fluorescing material is exteriorly observable through said light transparent portion of said sidewall.

12. The signalling device of claim 11, wherein said activating means is a rod which is received within said housing and extends exteriorly therefrom and contacts the door of the mailbox when it is opened so as to cause said light fluorescing material to move to said exteriorly observable position within said housing.

13. The signalling device of claim 12, wherein said rod includes a hooked end which overlies said post and is received within said lug, an intermediate portion which extends through said sidewall of said housing, and an arcuate shaped end which is raised upwardly and rides over the mailbox door when it is opened.

14. The signalling device of claim 13, wherein said tray and said bottom wall of said housing define communicating openings for draining condensation from the interior of said signalling device.

15. A signalling device for use with a mailbox having a swingable door, comprising:

a housing having an upper wall, lower wall and side wall, a first portion of said side wall being opaque and a second portion being transparent;

a light fluorescing means enclosed within said housing and being movable from a first non-observable position adjacent said first portion of said side wall of said housing to a second observable position adjacent said second portion of said side wall of said housing;

means for normally retaining said light fluorescing means in said first position; and activation means for moving said light fluorescing means, said activation means extending from said housing to adjacent the mailbox door when the device is mounted to a mailbox, such that when the mailbox door is opened, said activation means causes said light fluorescing means to move to said second position.

16. The signalling device of claim 15, wherein said light fluorescing means includes an upper face having a smooth surface, and a side face having a relatively rough surface with respect to said smooth surface.

17. The signalling device of claim 16, wherein said upper wall of said housing is transparent.

18. The signalling device of claim 17, wherein said means for normally retaining said light fluorescing means in said first position includes a magnet.

* * * * *